US007036581B2

(12) United States Patent
Trahan

(10) Patent No.: US 7,036,581 B2
(45) Date of Patent: May 2, 2006

(54) WELLBORE SEAL DEVICE

(75) Inventor: Kevin O. Trahan, The Woodlands, TX (US)

(73) Assignee: Allamon Interests, Montgomery, TX (US)

( * ) Notice: Subject to any disclaimer, the term of this patent is extended or adjusted under 35 U.S.C. 154(b) by 244 days.

(21) Appl. No.: 10/774,318

(22) Filed: Feb. 6, 2004

(65) Prior Publication Data

US 2005/0173110 A1 Aug. 11, 2005

(51) Int. Cl.
*E21B 33/128* (2006.01)

(52) U.S. Cl. ..... 166/186; 166/387; 166/208

(58) Field of Classification Search ..... 166/186, 166/191, 208, 120
See application file for complete search history.

(56) References Cited

U.S. PATENT DOCUMENTS

| | | | | | |
|---|---|---|---|---|---|
| 3,845,815 | A | * | 11/1974 | Garwood | 166/154 |
| 3,897,823 | A | * | 8/1975 | Ahlstone | 166/120 |
| 4,349,071 | A | * | 9/1982 | Fish | 166/124 |
| 4,671,354 | A | * | 6/1987 | Henderson et al. | 166/134 |
| 5,044,441 | A | * | 9/1991 | Rubbo et al. | 166/382 |
| 5,333,692 | A | | 8/1994 | Baugh et al. | |

* cited by examiner

*Primary Examiner*—Frank S. Tsay
(74) *Attorney, Agent, or Firm*—O'Neil & McConnell, PLLC; R. Perry McConnell

(57) ABSTRACT

A device for providing a seal between two tubular member in a downhole environment is presented. The sealing device provides the capability of "boosting" or improving the seal, in the event of hydraulic pressure increases from above or below the seal.

24 Claims, 5 Drawing Sheets

WELLBORE SEAL DEVICE

FIELD OF THE INVENTION

The invention relates to friction seals used in wellbores, whether metal-to-metal or other-material-to-metal, used to provide a fluid-tight boundary between a zone uphole of the seal and a zone downhole of the seal, and which are usually run into the wellbore in a run-in position and set once they are positioned in the wellbore.

BACKGROUND OF THE INVENTION

Friction seals are used in wellbores, such as oil and gas wells. These seals are used in situations in which the annulus between two essentially coaxial tubular members, such as a casing and a drill string, must be split into an uphole zone and a downhole zone which are in fluid isolation from each other.

Such seals, like that disclosed in U.S. Pat. No. 5,333,692 to Baugh, et al., may comprise a circular sealing ring which is mechanically mounted to the outer circumference of the inner tubular member. In the run-in position, this sealing ring and its mount are held in relatively close proximity to the inner tubular member, so that the inner tubular member and the seal may freely transit downhole into the proper setting position. Once in the setting position, the sealing ring must be forced outward into secure contact with the inner surface of the outer tubular member.

This sealing action is usually accomplished by actuating a setting device, such as a wedge-shaped ring, and using the setting device to force the sealing ring outward, deforming its mechanical mounting to the inner tubular member as necessary. Once sufficient force is applied, the sealing ring is forced into a tight surface-to-surface sealing arrangement between the outer surface of the sealing ring and the inner surface of the outer tubular member.

In the annulus between the inner and outer tubular members, the seal thus creates an uphole zone and a downhole zone which are in fluid isolation from each other. Leakage around the inner surface of the sealing ring is generally prevented by the presence of the wedge or other setting device which was used to force the sealing ring outward.

However, these sealing arrangements are not entirely reliable. Excess hydraulic pressure in the annulus between the two tubular members can cause the seal to slip in one direction or the other, pushing the seal out of the desired position. This situation may also cause deformation of the sealing surface with resultant leakage.

Accordingly, it is desirable to provide a sealing apparatus which utilizes any unbalanced or excess up-hole or down-hole hydraulic pressure to enhance the sealing force and to reinforce the strength of the seal.

It is an object of the invention to provide a seal for use in a wellbore which, once set, is reinforced by hydraulic pressure exerted against the sealing device from either an up-hole or a down-hole direction.

SUMMARY OF THE INVENTION

The invention is a settable seal for use in a wellbore which is mountable to a first tubular member, such as a casing string. In its initial position, the seal is maintained in relatively close relationship to the outer surface of the first tubular member. The first tubular member may be run downhole essentially coaxially with a second tubular member which has an inner diameter sufficient to allow passage of the first tubular member and any devices attached thereto, such as the sealing device.

Once the sealing device attached to the first tubular member has been positioned at a desired setting depth, it is necessary to actuate the setting mechanism and set the seal. This process is normally accomplished by applying force either above or below the sealing device and forcing one part of the sealing mechanism to move relative to another. Those of skill in the art will recognize that the process of controlling the force above or below the sealing mechanism may be accomplished in a number of ways. Further, the act of setting the sealing mechanism may be accomplished by moving the sealing ring itself in one direction or the other relative to the longitudinal axis of the first tubular member, or by moving another part of the sealing mechanism and maintaining the sealing ring essentially stationary relative to the longitudinal axis of the first tubular member.

Moreover, those of skill in the art will also recognize that the "up" or "down" orientation of the sealing device may be inverted without affecting the functioning of the device, and so the choice of orientation is a question of engineering choice. Accordingly, the function of the seal and the manner of setting it is discussed herein as though the seal is essentially stationary relative to the longitudinal axis of the first tubular member, and as though the sealing ring is positioned uphole of its mounting to the first tubular member. However, this description is by way of example only and is not limiting of the invention.

Applying pressure to a setting device, such as a cylindrical wedge mounted around the outer circumference of the first tubular member, forces the wedge into the annulus between the sealing ring and the first tubular member, thus deforming the ring and its mounting outward and forcing the outer surface of the sealing ring into a tight sealing contact with the inner surface of the second tubular member.

The wedge or other actuating device may be initially positioned in a "ready" position and restrained in that position with shear pins, or with another releasable holding device. Those of skill in the art will recognize that the purpose of such a holding device is to prevent premature setting to the seal, and thus that the choice of holding device is a matter of engineering choice appropriate to the circumstances. Further, it is preferable to provide a locking mechanism, such as a ratchet, between the first tubular member and the actuating device to prevent the actuating device from reversing direction once it has been moved into position to actuate the seal.

In accordance with the invention, the actuating device and the inner surface of the sealing ring are designed so that a first cavity exists between the actuating device and the inner surface of the sealing ring. In the preferred embodiment, this first cavity extends into the volume between the outer surface of the first tubular member and the inner surface of the mechanical connection between the first tubular member and the sealing ring. Fluid communication exists between the annular volume either above or below the sealing device and the first cavity.

As discussed above, this description and the detailed description of the drawings below reflect fluid communication between the cavity and the annular volume above the sealing device. However, those of skill in the art will understand that, for example, vertical inversion of the sealing mechanism is possible without constraining its function.

The fluid communication between these two regions may be accomplished in a variety of ways. For example, a wedge-shaped actuating device may have ribs formed on its outer surface, thus creating fluid channels between the outer surface of the wedge and the inner surface of the sealing ring. As an alternative example, channels may be formed in the inner surface of the sealing ring.

This fluid communication may be effected without detriment to the function of the seal, because the mechanical connection between the first tubular member and the second tubular member may be made sufficiently strong to preclude leakage from the first cavity. In the preferred embodiment, this mechanical connection may be held in position relative to the longitudinal axis of the first tubular member by positioning it against a stop ring, and the stop ring may itself be held in place by the provision of a stop ring. Further, a seal, such as an o-ring seal, is provided between the inner surface of the mechanical connection and the outer surface of the first tubular member. Accordingly, the mechanical connection of the sealing ring to the first tubular member may be securely positioned and made fluid-tight, so that the first cavity will not inadvertently create fluid communication between both ends of the seal. Additionally, the mechanical connection is preferably formed of ductile steel of sufficient thickness to provide the strength needed to prevent leakage.

In accordance with the invention, the fluid communication between the first cavity and the annular space either above or below the seal means that increased fluid pressure in the annular space will increase the fluid pressure in the first cavity. Accordingly, the seal is "boosted" by such increased pressure, because additional force is asserted outwardly on the sealing ring, forcing it into tighter contact with the inner surface of the second tubular member.

Similarly, increased fluid pressure in the annulus from the opposite direction will also boost the seal, because that pressure will tend to drive the mechanical connection and the sealing ring further against the actuating mechanism. In the preferred embodiment, the use of a wedge-shaped actuating mechanism will cause such pressure to again force the sealing ring further outward and into tighter contact with the inner surface of the second tubular member.

An alternative embodiment of the invention comprises a first sealing ring and a second sealing ring, each mechanically connected to the first tubular member. In this embodiment, the first and second sealing rings are each selectively positionable into a sealing relationship with the inner surface of the second tubular member by setting devices, such as cylindrical wedges. The first and second sealing rings are mechanically connected to the first tubular member in a vertically opposed configuration.

Between the first sealing ring and its respective setting device is a first cavity which is in fluid communication with the annular volume between the first and second tubular members at one end of the seal. Between the second sealing ring and its respective setting device is a second cavity which is in fluid communication with the annular volume between the first and second tubular members at the other end of the seal. In the preferred embodiment, the first and second cavities extend into the volume between the first tubular member and the respective mechanical connections to the first and second sealing rings.

When the seal of this embodiment is moved from the run-in position to the set position, force is applied to at least one of the setting devices. In the preferred embodiment, one setting device will be secured relative to the first tubular member, and the mechanical connections of the first and second sealing rings may be shifted relative to the first tubular member in accordance with the application of force to the other setting device. In this manner, one sealing ring is pushed into its set position by its motion relative to the setting device. In this position, the mechanical connection to the sealing rings will no longer be able to move relative to the first tubular member. Thus, the other sealing ring will also be made stationary relative to the first tubular member, and continued application of force to the nonstationary setting device will force this sealing ring into sealing relationship with the inner surface of the second tubular member.

Because the first and second cavities are in fluid communication with the annular volume at their respective ends of the seal, hydraulic pressure applied at either end of the seal will boost the seal by increasing the hydraulic pressure in the cavity at that end of the seal and thus increase the sealing pressure against the sealing ring.

Accordingly, the seal of this invention provides a seal which is boosted by increased hydraulic pressure from either direction.

DETAILED DESCRIPTION OF THE DRAWINGS

Figure 1:
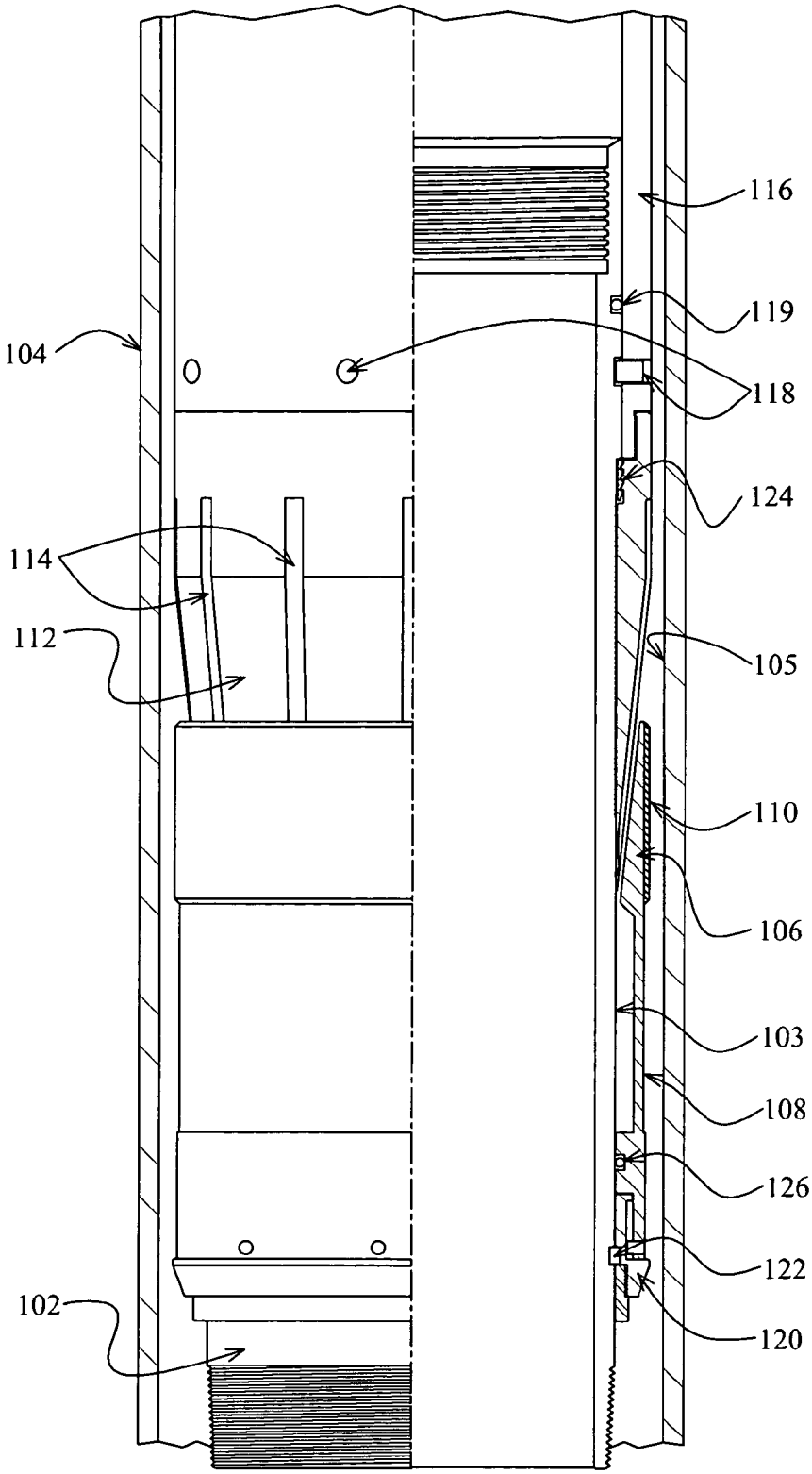
FIG. 1 is a half-sectional view of one embodiment of the invention in the run-in position.

Referring to FIG. 1, one embodiment of the seal of the invention is shown in the run-in position. The seal is mounted on a first tubular member 102, which is run downhole within second tubular member 104, such as a casing. The seal comprises a sealing ring 106 which is mounted on the first tubular member 102 by a mechanical connection 108. The outer surface of the sealing ring 106 may be covered with an elastomer material 110 which can enhance the gripping and sealing qualities when the sealing ring 106 is pressed into contact with the inner surface 105 of the second tubular member 104.

Mechanical connection 108 comprises an o-ring seal 126 to prevent leakage between the mechanical connection 108 and the outer surface 103 of the first tubular member 102. Additionally, mechanical connection 108 is held into position relative to the longitudinal axis of the first tubular member 102 by stop ring 120, which in turn is locked to the first tubular member 102 by lock ring 122.

When the sealing device is set, sealing ring 106 will be forced outward into sealing contact with the inner surface 105 of the second tubular member 104 by actuating member 112. The wedge shape of actuating member 112 also comprises ribs 114 which provide a fluid pathway between the actuating member 112 and the sealing ring 106.

Actuating member 112 will be moved into its set position by actuating setting member 116, which is initially held into position by shear pins 118. Seal 119 prevents leakage between the setting member 116 and the first tubular member 102. Those of skill in the art will recognize that setting member 116 may be actuated by applying force against setting member 116, shearing shear pins 118 and forcing actuating member 112 into its set position. Ratchet 124 provides locking force to prevent reverse motion of setting member 116 once it is actuated.

Figure 2:
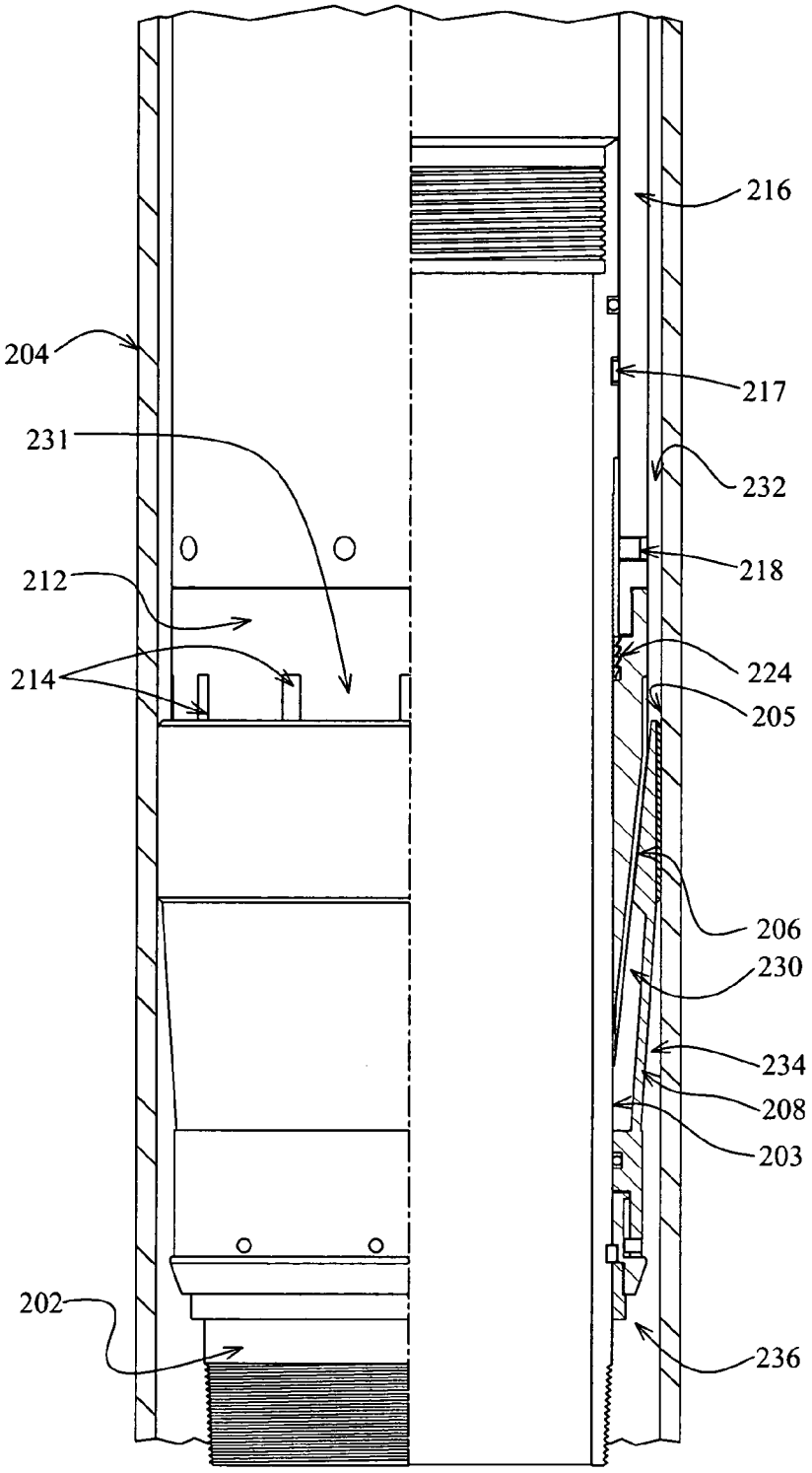
FIG. 2 is a half-sectional view of the embodiment of the invention shown in FIG. 1 in the set position.

Referring now to FIG. 2, the seal embodiment of FIG. 1 is shown in the set position. Setting member 216 has been actuated, shearing shear pins 218, and leaving tails 217 in the first tubular member 202. The movement of setting member 216 has forced actuating member 212 to move relative to the longitudinal axis of the first tubular member 202, and pressing sealing ring 206 outward into sealing contact with the inner surface 205 of the second tubular member 204. Ratchet 224 prevents actuating member 212 from being forced backward by spring pressure.

The ribs 214 on actuating member 212 create flow paths 231 between the first annular space 232 and first cavity 230. First cavity 230 includes the interstitial spaces between the ribs 214 (radially between sealing ring 206 and the actuating member 212) and preferably extends into the volume between outer surface 203 of the first tubular member 202 and the mechanical connection 208.

The sealing ring 206 and the mechanical connection 208 are deformed by movement of the actuating member 212 so that the sealing ring 206 provides a tightly sealing contact with inner surface 205 of the second tubular member 204.

Further, second cavity 234 is in fluid communication with the second annular space 236, but first and second annular spaces 232, 236 are in fluid isolation from each other. Thus, an increase in hydraulic pressure in first annular space 232 causes an increase in pressure in first cavity 230, thus exerting a greater outward force on sealing ring 206 and "boosting" the seal. Similarly, an increase in hydraulic pressure in second annular space 236 increases the hydraulic pressure in second cavity 234. The component of the pressure in second cavity 234 which is parallel to the longitudinal axis of first tubular member 202 will have the effect of forcing the sealing ring 206 tighter against actuating member 212, and thus into a tighter sealing contact with the inner wall 205 of the second tubular member 204 due to the wedge shape of actuating member 212, again boosting the seal.

Those of skill in the art will recognize that "up" and "down" may be reversed in FIGS. 1 and 2 without affecting the function of the seal. Accordingly, first annular space 232 can either be uphole or downhole from the sealing device.

Figure 3:
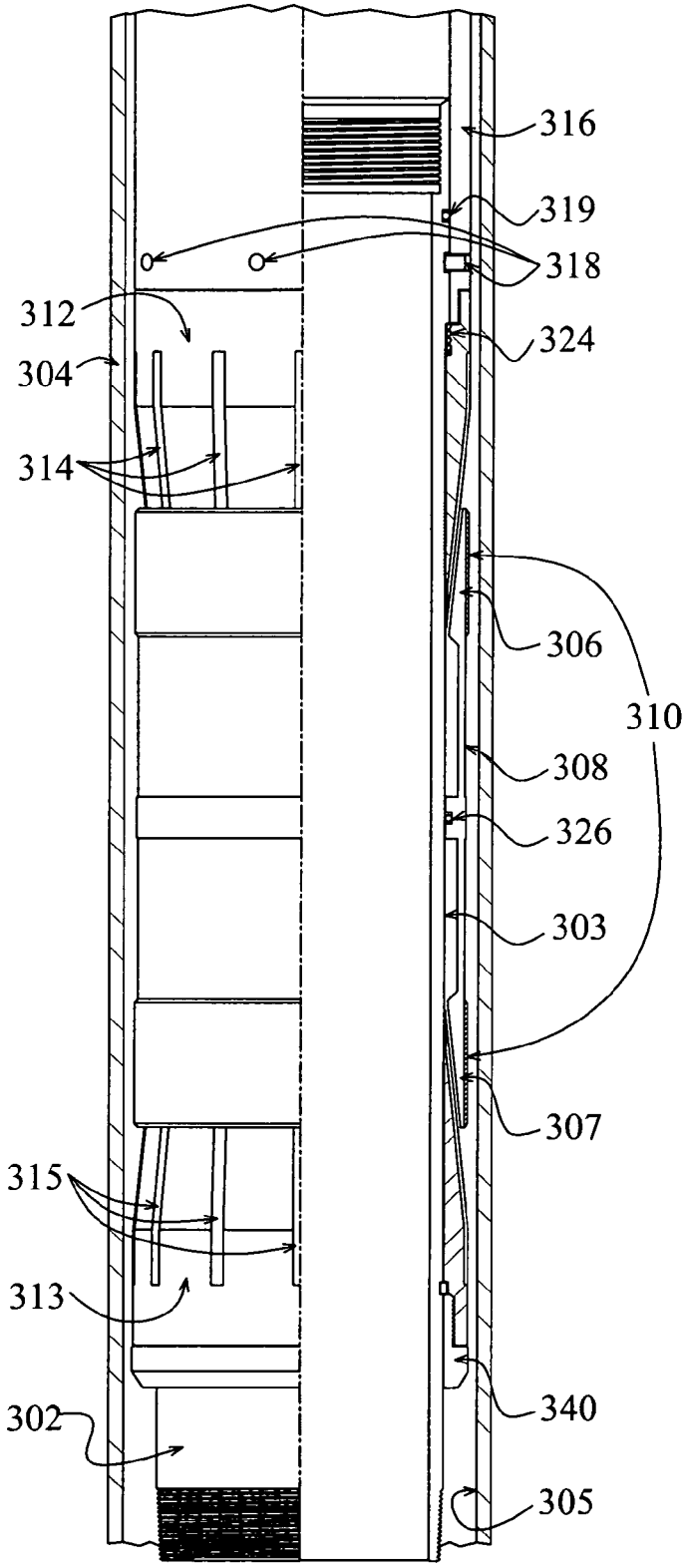
FIG. 3 is a half-sectional view of an alternative embodiment of the invention in the run-in position.

Referring to FIG. 3, an alternative embodiment of the device in the run-in position is shown. The seal is mounted on a first tubular member 302, which is run downhole within second tubular member 304, such as a casing. The seal comprises first sealing ring 306 which is mounted on the first tubular member 302 by mechanical connection 308, and second sealing ring 307 which is also mounted on the first tubular member 302 by mechanical connection 308. The outer surfaces of first and second sealing rings 306, 307 may be covered with an elastomer material 310 which can enhance the gripping and sealing qualities when first and second sealing rings 306, 307 are pressed into contact with the inner surface 305 of the second tubular member 304.

Mechanical connection 308 comprises an o-ring seal 326 to prevent leakage between the mechanical connection 308 and the outer surface 303 of the first tubular member 302. Seal 319 prevents leakage between actuating member 316 and the first tubular member 302. Those of skill in the art will recognize that actuating member 316 may be actuated by applying force against actuating member 316, shearing shear pins 318 and forcing first wedge 312 into its set position. Ratchet 324 provides locking force to prevent reverse motion of actuating member 316 once it is actuated.

When the sealing device is to be set, force will be applied to actuating member 316 sufficient to shear pins 318 and drive first wedge 312 against sealing ring 306. Friction between wedge 312 and sealing ring 306 initially forces first and second sealing rings 306, 307 and mechanical connection 308 to shift relative to first tubular member 302, causing second sealing ring 307 to push against second wedge 313. Second wedge 313 is precluded from moving relative to first tubular member 302 by positioning ring 340. Second sealing ring 307 is thus deformed and forced outward into a sealing relationship with inner surface 305 of second tubular member 304. When the sealing force between second sealing ring 307 and inner surface 305 is sufficient to preclude further movement of second sealing ring 307, the continued motion of first wedge 312 relative to first tubular member 302 forces first sealing ring 306 into a sealing relationship with inner surface 305.

First wedge 312 also comprises ribs 314 which provide a fluid pathway between first wedge 312 and first sealing ring 306. Similarly, second wedge 313 comprises ribs 315 which provide a fluid pathway between second wedge 313 and second sealing ring 307.

Figure 4:
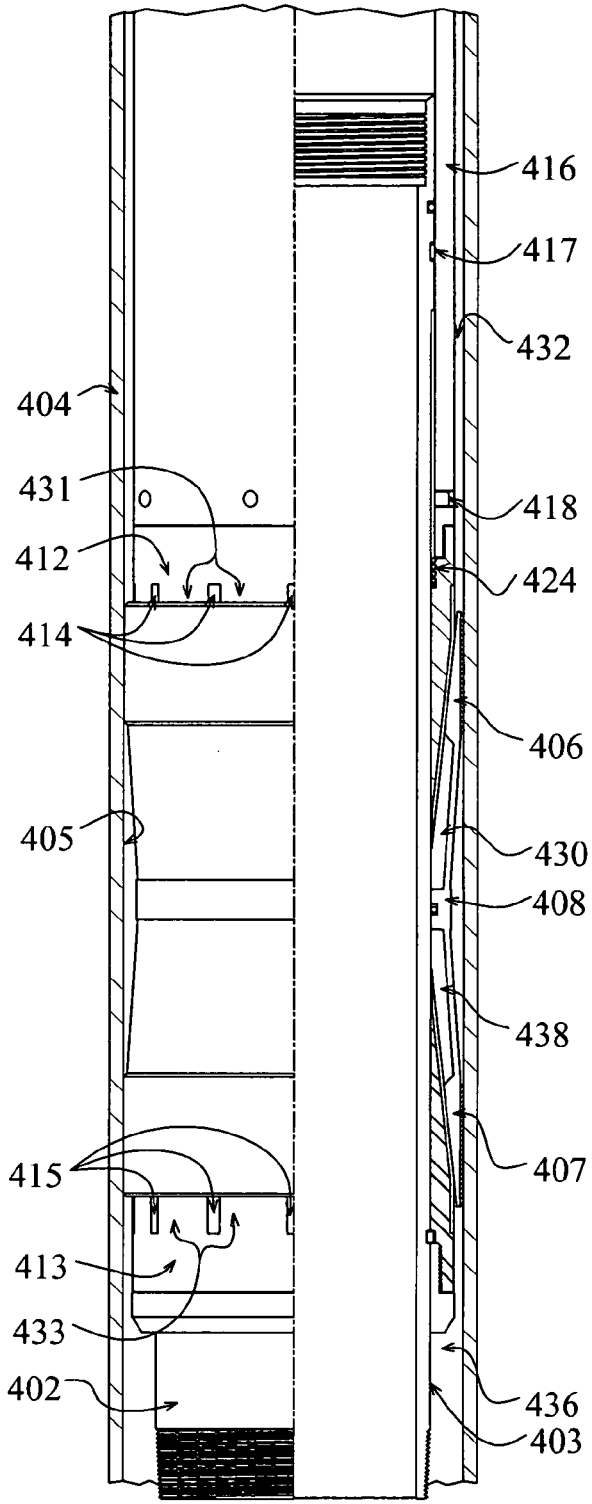
FIG. 4 is a half-sectional view of the embodiment of the invention shown in FIG. 3 in the set position.

Referring now to FIG. 4, the seal embodiment of FIG. 3 is shown in the set position. Actuating member 416 has been actuated, shearing shear pins 418, and leaving tails 417 in the first tubular member 402. The movement of actuating member 416 has forced first wedge 412 to move relative to the longitudinal axis of the first tubular member 402, and has moved first sealing ring 406, mechanical connection 408, and second sealing ring 407 relative to first tubular member 402. Second sealing ring 407 has been forced by second wedge 413 into sealing contact with the inner surface 405 of the second tubular member 404. Similarly, first sealing ring 406 has been forced by first wedge 412 into sealing contact with the inner surface 405. Ratchet 424 prevents first wedge 412 from being forced backward by spring pressure.

Ribs 414 on first wedge 412 create flow paths 431 between the first annular space 432 and first cavity 430. First cavity 430 includes the interstitial spaces between the ribs 414 (radially between first sealing ring 406 and the first wedge 412) and preferably extends into the volume between outer surface 403 of the first tubular member 402 and the mechanical connection 408. Similarly ribs 415 on second wedge 413 create flow paths 433 between the second annular space 436 and second cavity 438. Second cavity 438 includes the interstitial spaces between the ribs 415 (radially between second sealing ring 407 and the second wedge 413) and preferably extends into the volume between outer surface 403 of the first tubular member 402 and the mechanical connection 408.

The first and second sealing rings 406, 407 and the mechanical connection 408 are deformed by the setting operation so that first and second sealing rings 206, 207 provide a tightly sealing contact with inner surface 405 of the second tubular member 404.

Further, first cavity 430 is in fluid communication with first annular space 432, and second cavity 438 is in fluid communication with the second annular space 436, but first and second annular spaces 432, 436 are in fluid isolation from each other. Thus, an increase in hydraulic pressure in first annular space 432 causes an increase in pressure in first cavity 430, exerting a greater outward force on first sealing ring 406 and "boosting" the seal. Similarly, an increase in hydraulic pressure in second annular space 436 increases the hydraulic pressure in second cavity 438, exerting a greater outward force on second sealing ring 407 and "boosting" the seal.

Those of skill in the art will recognize that "up" and "down" may be reversed in FIGS. 3 and 4 without affecting the function of the seal. Accordingly, first annular space 432 can either be uphole or downhole from the sealing device.

Figure 5:
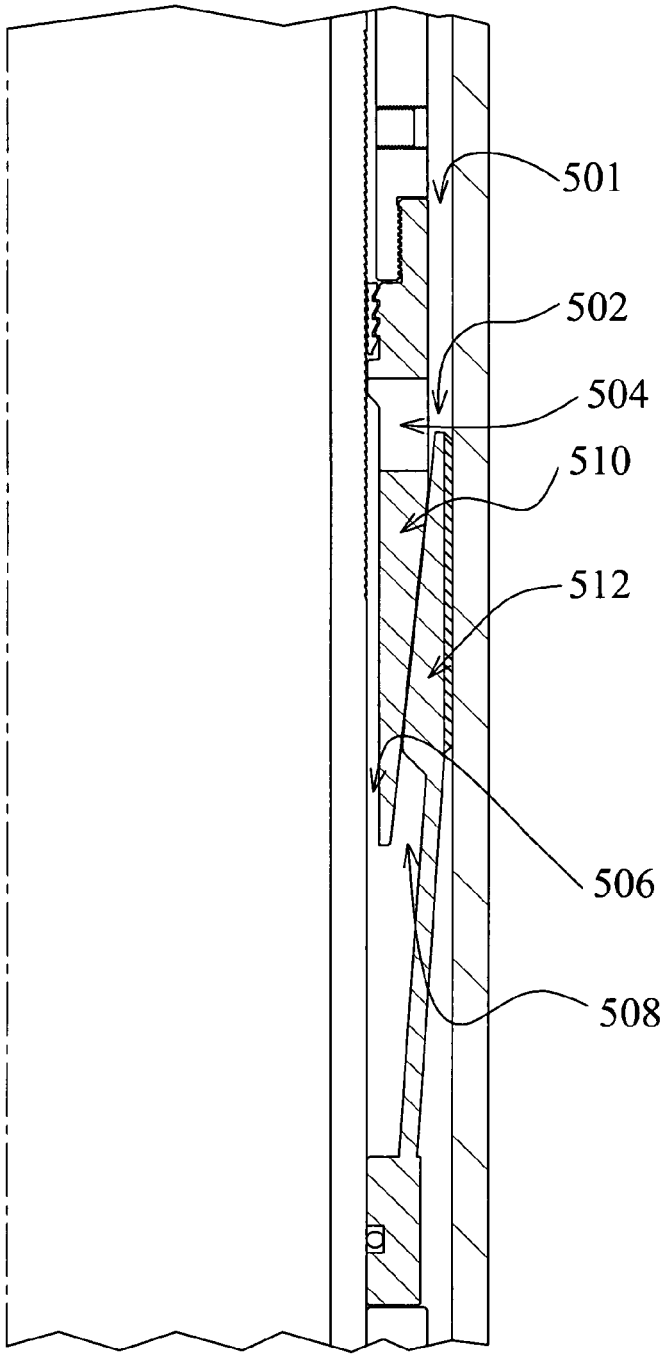
FIG. 5 is a half-sectional view of an alternative embodiment to the embodiment shown in FIG. 1, depicted in the set position.

In another alternative embodiment, referring to FIG. 5, fluid communication between the first cavity 508 and the first annulus 501 is maintained by providing a first fluid pathway between wedge 510 and sealing ring 512, wherein fluid may pass inlet 502. A fluid port 504 in wedge 510 provides fluid communication to a second fluid pathway 506 and then to first cavity 508. Those of skill in the art will recognize that such modifications to the fluid pathway do not alter the function of the invention.

Other variations in the construction of the invention may be made without departing from the spirit of the invention, and those of skill in the art will recognize that these descriptions are provide by way of example only, without limiting the scope of the invention.

I claim:

1. A seal for use in a well bore, comprising a first tubular member and a second tubular member, wherein said first tubular member is positionable within said second tubular member and separated therefrom by an annular volume, a sealing ring which is mechanically connected to said first tubular member and is selectively positionable into a sealing contact with said second tubular member, a first cavity between said first tubular member and said sealing ring, and a second cavity between said second tubular member and said mechanical connection, wherein said first cavity is in fluid communication with either the annular volume above or below the seal, and wherein said second cavity is in fluid communication with the other of said annular volumes.

2. The device of claim 1, wherein said sealing ring comprises an elastomer material.

3. The device of claim 1, wherein said mechanical connection between said sealing ring and said first tubular member comprises a stop ring.

4. The device of claim 3, wherein said stop ring comprises a lock ring.

5. The device of claim 1, wherein said mechanical connection between said sealing ring and said first tubular member comprises an O-ring.

6. The device of claim 1, additionally comprising a cylindrical wedge, wherein said wedge is selectively positionable to move said sealing ring into said sealing contact.

7. The device of claim 6, wherein said cylindrical wedge comprises a ratchet, and wherein said ratchet precludes reverse travel of said cylindrical wedge.

8. The device of claim 6, wherein said cylindrical wedge comprises ribs mounted on a surface of said wedge between said wedge and said sealing ring.

9. The device of claim 1, wherein said first cavity extends into a volume between said first tubular member and said mechanical connection.

10. A seal for use in a well bore, comprising a first tubular member and a second tubular member, wherein said first tubular member is positionable within said second tubular member and separated therefrom by an annular volume, a first sealing ring and a second sealing ring, wherein said sealing rings are mechanically connected to said first tubular member and are selectively positionable into a sealing contact with said second tubular member, a first cavity between said first tubular member and said first sealing ring, and a second cavity between said first tubular member and said second sealing ring, wherein said first cavity is in fluid communication with either the annular volume above or below the seal, and wherein said second cavity is in fluid communication with the other of said annular volumes.

11. The device of claim 10, wherein said first sealing ring comprises an elastomer material.

12. The device of claim 10, wherein said second sealing ring comprises an elastomer material.

13. The device of claim 10, wherein said mechanical connection between said first sealing ring and said first tubular member comprises an O-ring.

14. The device of claim 10, wherein said mechanical connection between said second sealing ring and said first tubular member comprises an O-ring.

15. The device of claim 10, additionally comprising a cylindrical wedge, wherein said wedge is selectively positionable to move said first sealing ring into said sealing contact.

16. The device of claim 10, additionally comprising a cylindrical wedge, wherein said wedge is selectively positionable to move said second sealing ring into said sealing contact.

17. The device of claim 15, wherein said cylindrical wedge comprises a ratchet, and wherein said ratchet precludes reverse travel of said cylindrical wedge.

18. The device of claim 16, wherein said cylindrical wedge comprises a ratchet, and wherein said ratchet precludes reverse travel of said cylindrical wedge.

19. The device of claim 15, wherein said cylindrical wedge comprises ribs mounted on a surface of said wedge between said wedge and said first sealing ring.

20. The device of claim 10, additionally comprising a cylindrical wedge, wherein movement of said first sealing ring or said second sealing ring relative to said wedge positions that sealing ring in sealing contact with said inner surface of said second tubular member.

21. The device of claim 10, wherein said first cavity extends into a volume between said first tubular member and said mechanical connection between said first tubular member and said first sealing ring.

22. The device of claim 10, wherein said second cavity extends into a volume between said first tubular member and said mechanical connection between said first tubular member and said second sealing ring.

23. The device of claim 20, wherein said cylindrical wedge comprises ribs mounted on a surface of said wedge.

24. A device for creating a seal in a well bore, comprising a first tubular member and a second tubular member, wherein said first tubular member is positionable within said second tubular member and separated therefrom by an annular volume, a seal, wherein said seal is mechanically connected to said first tubular member and is selectively positionable into a sealing contact with said second tubular member, a first fluid cavity adjacent said seal, and a second fluid cavity adjacent said seal and in effective fluid isolation from said first fluid cavity, wherein an increase in fluid pressure in either of said first or second fluid cavities reinforces said seal.

* * * * *